US007383641B2

(12) United States Patent
Fernandes et al.

(10) Patent No.: US 7,383,641 B2
(45) **Date of Patent: *Jun. 10, 2008**

(54) TAD EDGE RESIST FABRICS FOR PAPER WEB DRYING

(75) Inventors: Lippi Alves Fernandes, Overijssel (NL); Sanjay Patel, Summerville, SC (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/517,084

(22) Filed: Sep. 7, 2006

(65) Prior Publication Data

US 2007/0068030 A1 Mar. 29, 2007

Related U.S. Application Data

(60) Provisional application No. 60/721,321, filed on Sep. 27, 2005.

(51) Int. Cl.
*F26B 11/02* (2006.01)

(52) U.S. Cl. ..... 34/115; 442/218; 162/361

(58) Field of Classification Search ..... 34/115, 34/116; 442/218; 162/361
See application file for complete search history.

(56) References Cited

U.S. PATENT DOCUMENTS

| | | | | |
|---|---|---|---|---|
| 3,222,246 | A * | 12/1965 | Lee | 162/349 |
| 5,506,033 | A | 4/1996 | Smith | 428/192 |
| 6,503,602 | B1 * | 1/2003 | Crosby | 428/193 |
| 6,531,033 | B1 * | 3/2003 | Kawashima | 162/306 |

FOREIGN PATENT DOCUMENTS

| | | |
|---|---|---|
| DE | 19934879 | 7/1999 |

* cited by examiner

*Primary Examiner*—Stephen Gravini
(74) *Attorney, Agent, or Firm*—Taylor & Aust, P.C.

(57) ABSTRACT

A through air dryer (TAD) fabric having a composite configuration whereby side fabric portions made of a more resistant material are woven to the main body portion of the fabric. Side fabric portions that are not protected from the paper web, and therefore exposed to harsher environmental conditions than the portion of the fabric covered by the paper web, deteriorate faster. By replacing the side portions that are exposed to harsher environment with more resistant material, the TAD fabric will last longer.

17 Claims, 2 Drawing Sheets

TAD EDGE RESIST FABRICS FOR PAPER WEB DRYING

CROSS-REFERENCE TO RELATED APPLICATIONS

The present application claims priority under 35 U.S.C. §119 of U.S. patent application No. 60/721,321 filed 27 Sep. 2005, the disclosure of which is expressly incorporated by reference herein in its entirety.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The invention relates to through air dryer (TAD) fabrics, and more particularly, to TAD fabrics have a composite whereby side fabric portions are woven to the main body portion of the fabric.

2. Background of the Invention

There is continuing need to improve the fabrics used in TAD applications. For typical dryers such as non-TAD, there is a need to alternate standard and, for example, PPS yarns, to prevent tension variation during the heat-setting process. Still further, PPC is used in some fabrics across the entire width of the fabric, and this is very expensive. PPS does not have the same level of tenacity as PET, so a combination is better.

In many TAD machines, the paper that is produced is trimmed at the forming section prior to being transferred to the TAD fabric. At the TAD section, as depicted in FIG. 1, hot air is blown going through the paper 100 and passing through the fabric 102 and drum 104. However, as the paper was previously trimmed, there is an area of the fabric 106 that received more air flow at higher temperatures.

The result is that the fabric that is not in contact or otherwise protected by the paper web is exposed to the harsher paper machine running conditions than if the fabric was protected by the web. This result in premature wear or other destruction of the fabric.

Accordingly, a need exists for a TAD fabric having the ability to survive under the harsh environments longer by postponing the wear at the exposed sides of the fabric.

BRIEF SUMMARY OF THE INVENTION

A TAD fabric meeting the needs discussed above is achieved using a composite fabric for through air drying having a fabric body fabricated from a first material and having a first side portion and a second side portion, wherein the first side portion is fabricated from a second material. Similarly, the second side portion can be fabricated using a third material, or the second material and the third material can be the same material.

In prior art TAD applications, part of the fabric is not protected by the paper web. More specifically, the edge portions of the, the edge portions of the fabric, when not in contact or otherwise covered by the web, is exposed to the harsher environment of the paper machine running conditions.

In the present invention, a new edge material is added to the main portion of the fabric. That is, a main central portion of the fabric running in the machine direction has additional side panels added. The paper web generally covers the main middle portion, and overlays, or extends to cover a portion of the side portions.

In the composite fabric, the first side portion is woven to the fabric body along one side edge. The second side portion is woven to the fabric body along a second side edge. The second side edge is opposite the first side edge. The first and second side portions can be woven to the fabric body on the same loom.

Likewise, the first and second portions can have the same weave pattern as the fabric body.

Still further, the first and second side portions can be subjected to the same processing as the fabric body, for example, heat setting, stretching, coating, and the like. When a coating is utilized, the coating, when compared to the composite fabric, has at least one of enhanced release properties, enhanced wear properties and enhanced thermal stability.

The material used for the body of the composite fabric is at least one of polyester and polyethylenepterathalate (PET).

The material used for the first side portion is at least one of polyphenylenesulfide (PPS), polyetheretherketone (PEEK), high temperature and hydrolysis resistant polymers, blends using PPS, blends using PEEK, alloys of PPS, alloys of PEEK, and high temperature nylon. The high temperature nylon is at least one of a variant of nylon 66 and an aromatic nylon.

Additionally, the diameter of the material used for the first side portion can be substantially the same as the diameter of the first material.

When the first side portion is woven to the fabric body, it is preferably woven in the same plane.

It is also preferred that the fabric body and the first side portion have substantially the same CFM throughput. However, depending on the design parameters, the CFM throughput of the first side portion can be different from the fabric body, or may be different from the second side portion.

Additionally, it is preferred that there is a smooth transition between the main portion of the fabric and the side portions.

The size of the first and second side portions is dependent upon the size of the paper web. In the preferred embodiment, the width of the side portions is approximately 20-40 cm when measured in the weft direction.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 2:
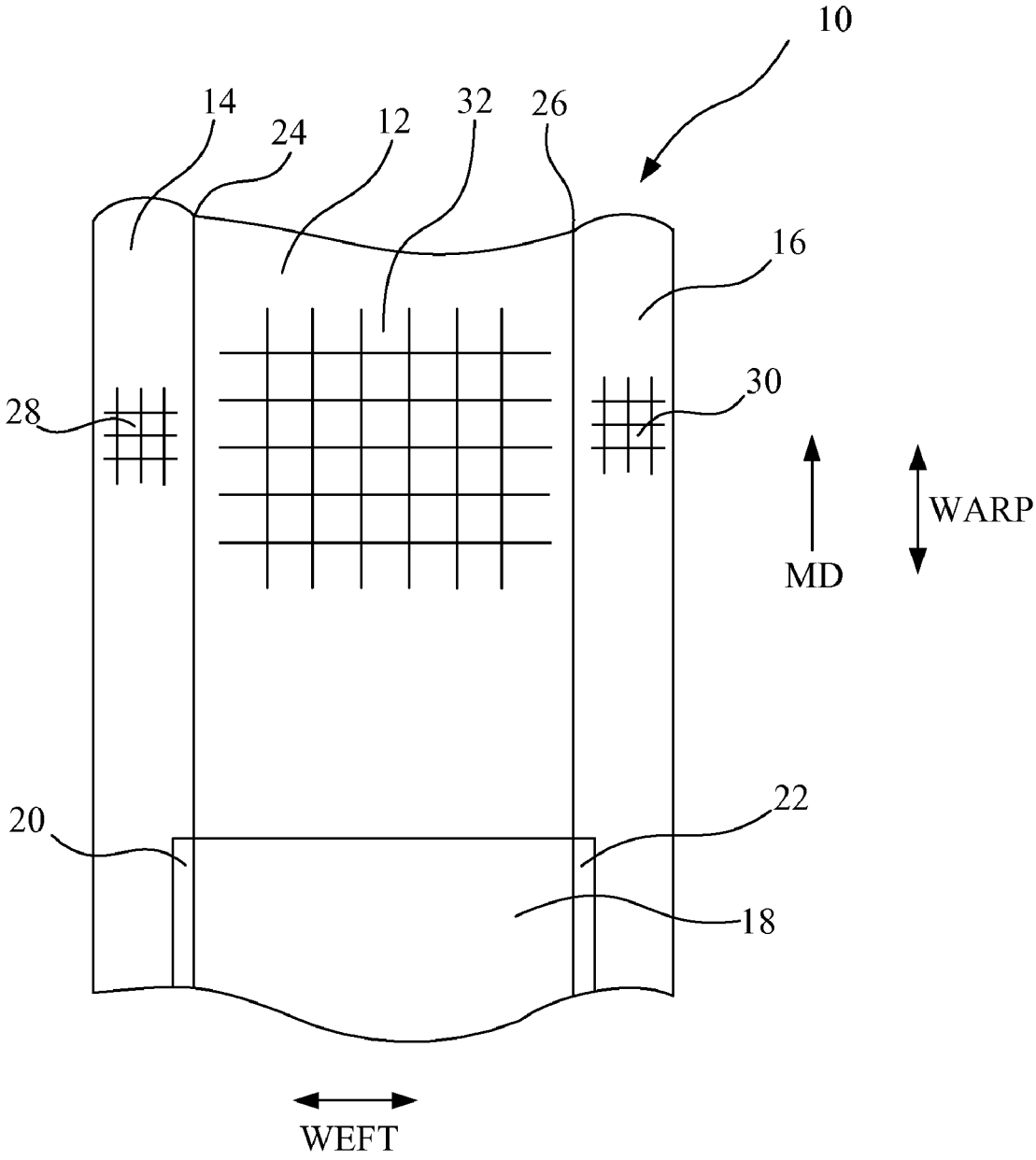
FIG. 2 is a plan view of paper side of the composite fabric of the invention.

FIG. 2 depicts a plan view of the composite fabric 10 of the present invention. The composite fabric has a central fabric portion 12, a first fabric side or outer edge portion 14, and a second fabric side or outer edge portion. MD indicates the machine direction of the composite fabric.

Figure 1:
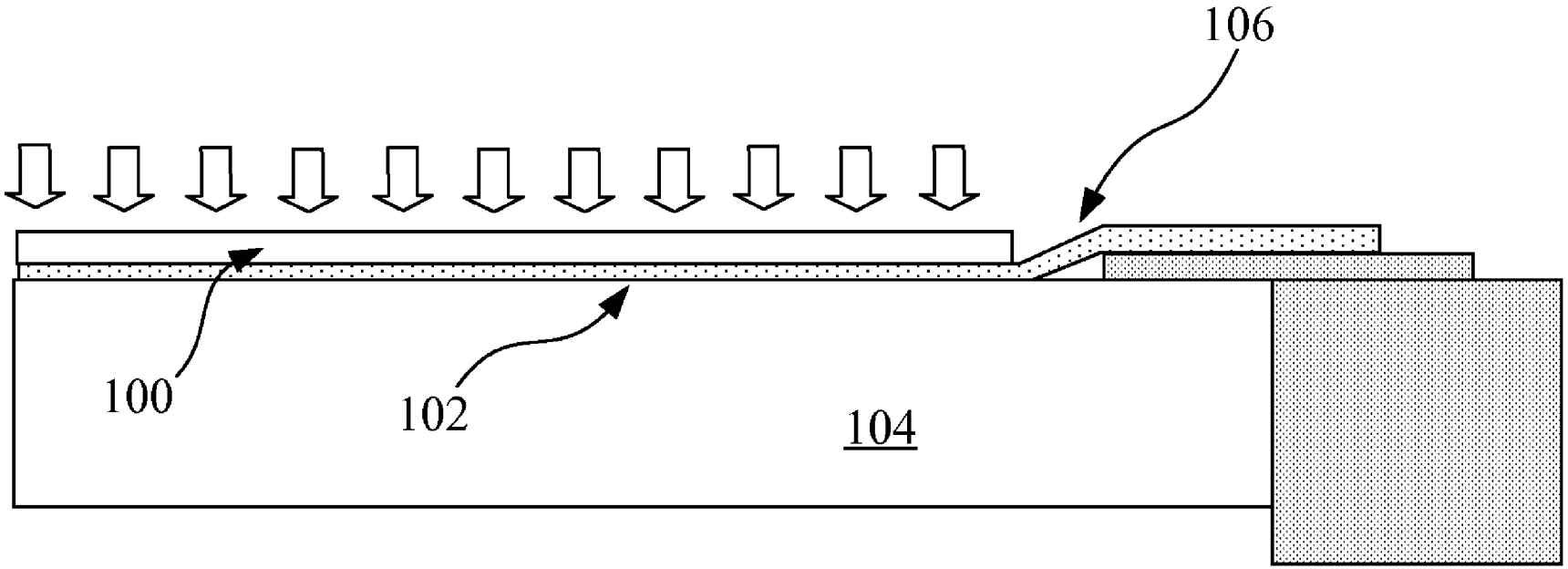
Fig. 1 PRIOR ART
FIG. 1 is a cross section of the prior art.

It is understood that the first fabric side portion 14 and the second fabric side portion 16 are interchangeable, and reference to one may be interchanged with the other. Stated differently, the plan view of FIG. 1 may represent either the paper side or the drum side.

The central portion 12 can be any woven TAD fabric. The material used for the central portion 12, also known as the body of the composite fabric, is preferably at least one of polyester and polyethylenepterathalate (PET).

The first fabric side portion 14, or new edge material, is added to the central fabric portion 12. That is, the central fabric portion of the fabric running in the machine direction has additional side panels 14, 16. The paper web 18 generally covers the central fabric portion 12, and overlays, or extends to cover a portion of the side portions 14, 16 at first and second paper web overlays 20, 22.

In the composite fabric, the first side portion 14 is woven to the central fabric portion 12 along a first side edge 24. The second fabric side portion 16 is woven to the central fabric portion 12 along a second side edge 26. The second side edge 26 is opposite the first side edge 24. The first and second fabric side portions 14, 16 can be woven to the central fabric body 12. This weaving of the first and second fabric side portions 14, 16 to the central fabric body 12 is preferably performed on the same loom on which the central fabric body was woven.

There is no requirement that the first fabric side portion 14 have the same weave pattern as the central fabric portion 12 or the second fabric side portion 16. In the preferred embodiment, the first and second fabric portions 14, 16 have the same weave pattern. Additionally, it is preferable that the first and second fabric portions 14, 16 have the same weave pattern as the central fabric portion 12.

Still further, the first and second fabric side portions 14, 16 can be subjected to the same processing as the central fabric portion 12. For example, heat setting, stretching, coating, and the like. When a coating is utilized, the coating, when compared to a composite fabric without the coating, has at least one of enhanced release properties, enhanced wear properties and enhanced thermal stability.

The material used for the central fabric portion 12 of the composite fabric 10 is preferably at least one of polyester and polyethylenepterathalate (PET).

The material used for the first fabric side portion 14 and/or the second fabric side portion 16 is preferably at least one of polyphenylenesulfide (PPS), polyetheretherketone (PEEK), high temperature and hydrolysis resistant polymers, blends using PPS, blends using PEEK, alloys of PPS, alloys of PEEK, and high temperature nylon. The high temperature nylon is at least one of a variant of nylon 66 and an aromatic nylon.

Additionally, the diameter of first fabric side portion fibers 28 used for the first fabric side portion 14, and the diameter of second fabric side portion fibers 30 used for the second fabric side portion 16 can be substantially the same as the diameter of the central fabric portion fibers 32 used for the central fabric portion 12.

When the first side portion is woven to the fabric body, it is preferably woven in the same plane.

It is also preferred that the fabric body and the first side portion have substantially the same CFM throughput. However, depending on the design parameters, the CFM throughput of the first side portion can be different from the fabric body, or may be different from the second side portion.

Additionally, it is preferred that there is a smooth transition between the main portion of the fabric and the side portions.

The size of the first and second fabric side portions 14, 16 is predetermined and can be based upon the size of the paper web. In the preferred embodiment, the width of each of the fabric side portions 14, 16 is approximately 10-60 cm when measured in the weft direction, preferably approximately 20-40 cm.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present extends to all functionally equivalent structures, methods and uses, such as are within the scope of the appended claims.

What is claimed as new and desired to be protected by Letters Patent of the United States is:

1. A composite fabric for through air drying of a paper web, said composite fabric comprising: a fabric body including a central portion fabricated from a first material and having a first outer edge portion and a second outer edge portion, wherein the first outer edge portion is fabricated from a second material and wherein the paper web covers the central portion of the fabric and overlays to cover and contact at least a portion of at least one of the outer edge portions.

2. The composite fabric of claim 1, wherein the second side portion is fabricated using a third material.

3. The composite fabric of claim 2, wherein the second material and the third material are the same material.

4. The composite fabric of claim 1, wherein the first side portion is woven on the same loom as the fabric body.

5. The composite fabric of claim 1, wherein the first side portion has the same pattern as the fabric body.

6. The composite fabric of claim 1, wherein the first side portion has the same processing as the fabric body.

7. The composite fabric of claim 1, further comprising a coating.

8. The composite fabric of claim 7, wherein the coating, when compared to the composite fabric, has at least one of enhanced release properties, enhanced wear properties and enhanced thermal stability.

9. The composite fabric of claim 1, wherein the second material is at least one of polyphenylenesulfide (PPS), polyetheretherketone (PEEK), high temperature and hydrolysis resistant polymers, blends using PPS, blends using PEEK, alloys of PPS, alloys of PEEK, and high temperature nylon.

10. The composite fabric of claim 9, wherein the high temperature nylon is at least one of a variant of nylon 66 and an aromatic nylon.

11. The composite fabric of claim 1, wherein the first material is at least one of polyester and polyethylenepterathalate (PET).

12. The composite fabric of claim 1, wherein the diameter of the second material is substantially the same as the diameter of the first material.

13. The composite fabric of claim 1, wherein the first side portion has a plane in the same plane as the fabric body.

14. The composite fabric of claim 1, wherein the fabric body and the first side portion have substantially the same CFM throughput.

15. The composite fabric of claim 1, wherein the fabric body and the first side portion have different CFM throughput.

16. The composite fabric of claim 1, wherein the first side portion has a width of approximately 10-50 cm in a weft direction.

17. The composite fabric of claim 1, wherein the second side portion has a width of approximately 10-50 cm in a weft direction.

* * * * *